United States Patent [19]

Nesbitt et al.

[11] 4,304,009

[45] Dec. 8, 1981

[54] ENERGY ABSORBING SAFETY HELMET

[75] Inventors: Lanny E. Nesbitt, Strasburg; Mieczyslaw Saganowski, Wyomissing, both of Pa.

[73] Assignee: Inco Safety Products Company, Philadelphia, Pa.

[21] Appl. No.: 143,763

[22] Filed: Apr. 25, 1980

[51] Int. Cl.[3] ..... A42B 3/00

[52] U.S. Cl. ..... 2/416

[58] Field of Search ..... 2/416, 417, 418, 419, 2/420

[56] References Cited

U.S. PATENT DOCUMENTS

| | | | |
|---|---|---|---|
| 2,853,708 | 9/1958 | Austin | 2/416 |
| 3,054,111 | 9/1962 | Hornickel | 2/416 |
| 3,192,536 | 7/1965 | Benner | 2/418 |
| 3,388,405 | 6/1968 | Simpson et al. | 2/418 |
| 3,497,873 | 3/1970 | Benner | 2/414 |
| 3,555,560 | 1/1971 | Rascke | 2/416 |
| 3,599,239 | 8/1971 | Tatum | 2/416 |
| 4,055,860 | 11/1977 | King | 2/416 |
| 4,106,127 | 8/1978 | Marangoni et al. | 2/416 |

FOREIGN PATENT DOCUMENTS

| | | | |
|---|---|---|---|
| 1210925 | 5/1960 | France | 2/416 |

*Primary Examiner*—Louis Rimrodt

*Attorney, Agent, or Firm*—Raymond J. Kenny; Edward A. Steen

[57] ABSTRACT

A safety helmet (10) including an impact absorbing shell (12) and a number of energy absorbing strap retainers (34) is disclosed. A plurality of sockets (20) receive the retainers (34). The retainers (34) include a pair of flexible shock absorbing wings (46) which are designed to nest against lands (30). Upon the application of a blow to the helmet (10), the wings (46) flex and absorb a portion of the impact.

7 Claims, 8 Drawing Figures

ENERGY ABSORBING SAFETY HELMET

TECHNICAL FIELD

The invention claimed herein relates to safety helmets in general and more particularly to an energy or shock absorbing suspension system especially suited for use with such protective devices.

BACKGROUND ART

Industrial workers often wear safety helmets or hats to protect themselves from falling objects, electrocution and bumping their heads. The helmets are designed to reduce or hopefully eliminate serious head injuries. To put the problem in proper perspective, it has been reported that there are an average of about 152,000 head injuries per year. Furthermore, approximately eight percent of all accidental electrocutions are caused by the head making contact (directly or indirectly) with an electrical source.

In view of these dangers, various helmet standards have been established over the years to ensure the safety of the helmet wearing populace. See, for example, ANSI Z89.1-1969 entitled, "Safety Requirements for Industrial Head Protection" and ANSI Z89.2-1971 entitled, "Safety Requirements for Industrial Protective Helmets for Electrical Workers, Class B". Both of the aforementioned standards are published by the American National Standards Institute, Inc. These references, among others, set forth minimum guidelines for the manufacture of safety helmets.

Briefly, a safety helmet protects the wearer in various ways. Firstly, the shell deflects a blow to the head. A well designed hat will dissipate the blow over the entire surface of the shell. Should the force of the impact be great enough, the hat will shatter thereby reducing the kinetic energy of the moving object eventually reaching the worker's head. Moreover, the internal helmet suspension is designed to absorb a substantial portion of the blow. Secondly, an electrical safety hat must meet certain minimum requirements for dielectric strength and imperviousness to moisture. Such hats, obviously, must not act as conduits for electric current. Thirdly, by simply wearing a hat, a mechanical barrier is set up between the head and the environment. In this fashion, the deleterious effects of acid spills, hot liquid spills and airborne contaminants are substantially reduced.

Of all the aforementioned uses of a safety hat, probably its most important function is energy attenuation. It goes without saying that the greater the ability of a helmet to deflect and absorb an impact, the safer the hat. Since the energy characteristics of a shell are more or less determined by the elastic properties of the shell material, there is relatively little a helmet designer may do to improve the shock absorbing characteristics of the shell itself. Accordingly, it is the suspension system of a safety helmet that is the subject of this disclosure.

Present day suspension systems basically consist of a plurality of interconnecting straps forming a webbed, head-circumscribing structure within the helmet. The webbing is, in turn, attached to the helmet by a series of fixed mounts, usually imbedded within the shell itself. A headband (usually adjustable) is affixed to the webbing in a known manner. Any shock transmitted from the shell to the suspension system is partially alleviated by the elastic nature of the webbing. However, it is still very possible that an undesirably high amount of force will be transmitted to the head. Accordingly, it is very important that a minimum clearance be maintained between the shell and the webbing to accommodate the shock of a blow. The problem with present day designs is that by using fixed suspension mounting systems, a substantial portion of the blow is still physically transmitted directly to the wearer's head. The kinetic energy engendered by the blow is not effectively reduced since the fixed mount is not designed to absorb the impact. Indeed, a fixed mount may act as a direct transmitter of the shock to the head.

Clearly, an improved suspension system that absorbs a portion of the blow is desirable.

SUMMARY OF THE INVENTION

The disclosed invention is directed towards a flexible energy absorbing suspension system for safety helmets. By utilizing the instant invention, an additional energy attenuating structure is employed to further reduce the chances of a serious head injury engendered by a sharp blow to the helmet.

Briefly, a safety helmet includes an impact absorbing shell and a suspension system disposed therein. A plurality of sockets are integrally formed within the shell. A matching number of strap retainers are detachably inserted into the sockets. The retainers include a pair of flexible shock absorbing wings whereas the sockets are specifically designed to: (1) securely, but temporarily, retain the retainers within the sockets and (2) provide a receiving surface or land for each flexible wing. Moreover, an adjustable headband and a plurality of straps, forming a web-like head cradling structure, are affixed to the retainers.

The resulting suspension system improves the desirable shock absorbing characteristics of the safety helmet in that in addition to the shell and web, there is now provided a third shock absorber, namely the flexible wings.

PREFERRED MODE FOR CARRYING OUT THE INVENTION

Figure 1:
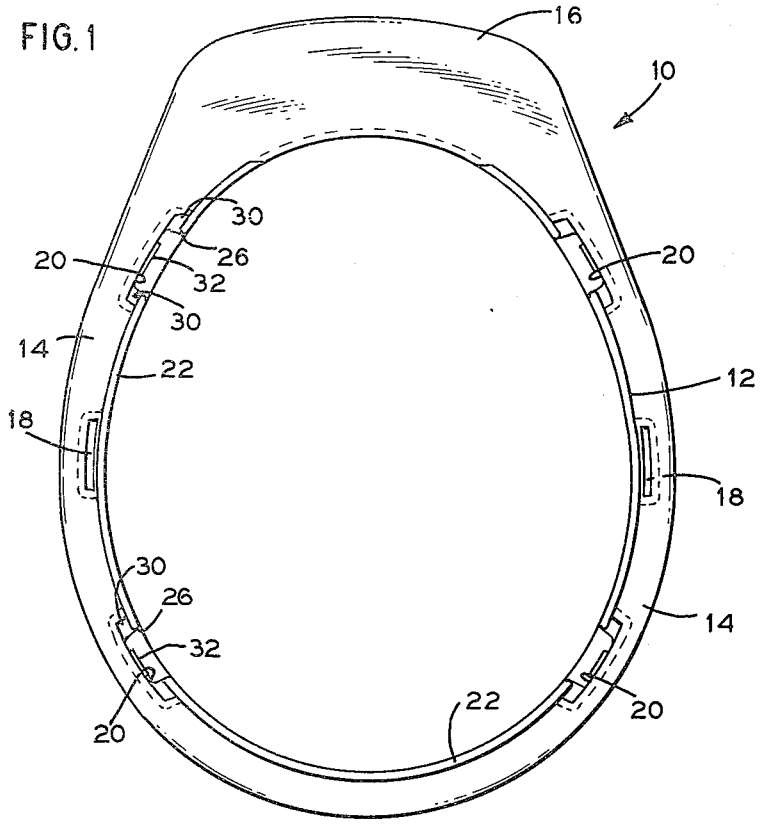
FIG. 1 is a bottom view of a helmet shell embodying the invention.

Referring to FIG. 1, there is shown a bottom view of a safety helmet 10 having an impact-resistant polyethylene shell 12. Although a polyethylene shell 12 is preferred in most instances, other materials, such as aluminum may be utilized as well. Disposed about the periphery of the shell 12 is a brim 14. A peak 16 forwardly extends from the brim 14. Accessory slots 18 accommodate ear muffs, welding helmets, face shields, goggles and the like. A plurality of sockets 20 are integrally molded into the shell 12. Reinforcing strip 22 substantially circumscribes the shell 12 to provide additional rigidity to the helmet 10.

Figure 3:
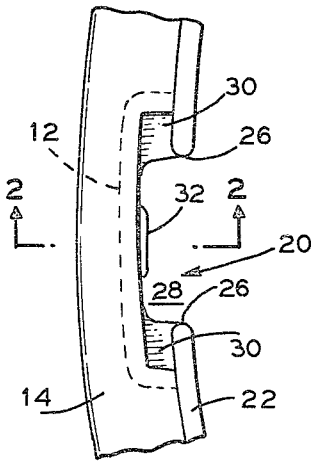
FIG. 3 is a detailed view of FIG. 1.
Figure 2:
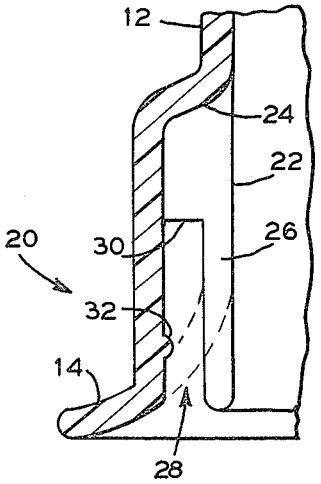
FIG. 2 is a sectional view (inverted) taken along line 2—2 of FIG. 3.

Referring specifically to FIGS. 2 and 3, the sockets 20 are formed by an indentation 24 integrally formed within the shell 12 and a gap in the strip 22. The end surfaces 26 of the strip 22, together with the indentations 24 form recess 28. Lands 30 bridge the shell 12 with the end surfaces 26 over the recess 28. Nub 32 partially extends into the recess 28.

Figure 4:
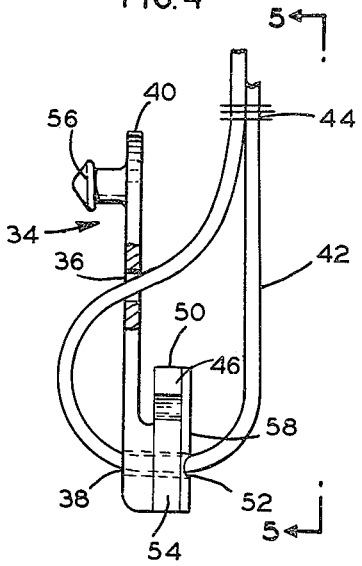
FIG. 4 is a side view, in partial cross section, of a feature of the invention.
Figure 5:
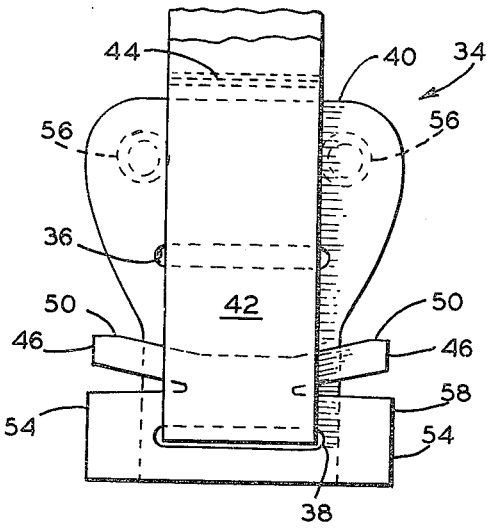
FIG. 5 is a view taken along line 5—5 of FIG. 4.

FIGS. 4 and 5 depict two views of a strap retainer 34. The strap retainer 34 is designed to fit securely into the sockets 20. The rationale for this design will become evident from the subsequent discussion.

The retainer 34 is essentially a J-shaped structure (see FIG. 4) having two apertures 36 and 38. Longer section 40 includes a pair of buttons 56 for detachably affixing the retainer 34 to a headband (not shown). Shorter section 58 is sized to fit into the sockets 20. When it is desired to remove the headband from the helmet 10 while simultaneously keeping the retainers 34 affixed to the shell 12, one merely unbuttons the headband from the buttons 56. Other attaching means, such as snaps, may be utilized as well. A sweatband (not shown) may be disposed about the headband. The headband may be made from low density polyethylene whereas the sweatband may be made from vinyl.

Strap 42, which forms, in combination with other straps, a webbed suspension system, is intertwined through the apertures 36 and 38. The strap 42 may be fastened together 44 by any known means. The strap 42 may be made from a nylon weave.

The retainer 34 includes a pair of flexible upturned wings 46 disposed on the shorter section 58. Each wing 46 has a flat surface 50. The aperture 38 has a slight recess 52 to accommodate the nub 32. Inasmuch as the retainer 34 must flex when subjected to compressive and tensile forces, it is preferred to construct the retainer 34 out of high density polyethylene.

Figure 6:
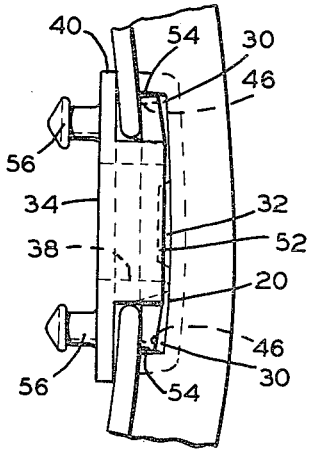
FIG. 6 is a detailed view of a feature of the invention.

FIG. 6 depicts the retainer 34 disposed within the helmet 10. Note how the retainer 34 is snap fitted within the socket 20. Due to the slight curvature of the helmet 10, the short section 58 will be slightly arcuated when it is seated within the socket 20. The wings 46 are in flexible registry with the lands 30 whereas the nub 32 is in registry the recess 52. The socket 20 is sized to accommodate the strap 42.

Figure 7:
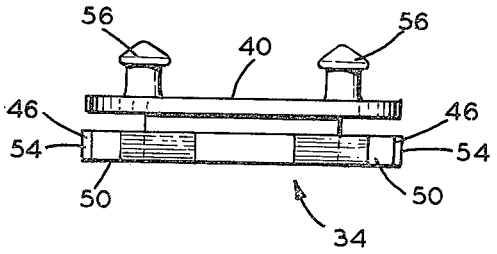
FIG. 7 is a top plan view of a feature of the invention.
Figure 8:
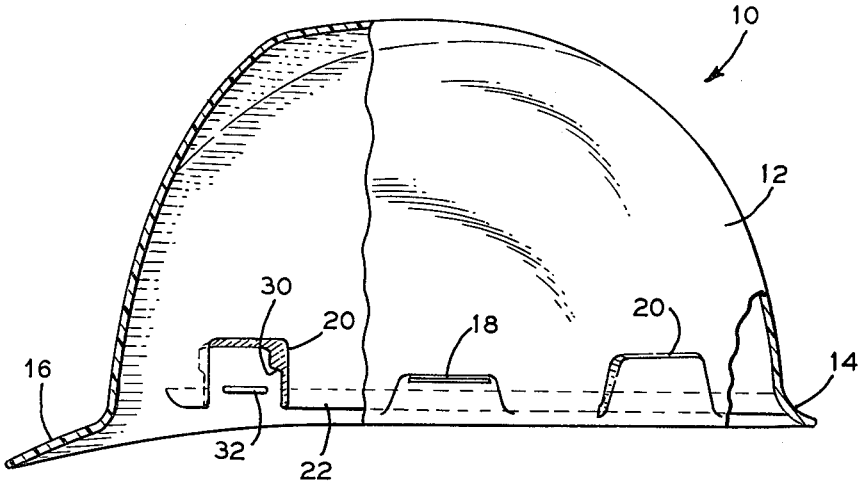
FIG. 8 is a side view, in partial cross section, of a safety hat.

FIG. 7 is a top view of the retainer 34. FIG. 8 is a view of the shell 12 without the retainers 34.

The invention and the matter of applying it may, perhaps, be better understood by a brief discussion of the principles underlying the invention.

As was discussed previously, the instant invention provides an additional means for absorbing a blow directed to a safety helmet. Specifically, the socket 20 and the retainer 34 are designed to absorb the shock in tandem. As can be seen in FIG. 6, the retainer 34 is inserted into the socket 20 until the nub 32 is securely nested within the recess 52. The grasping action of the nub/recess combination provides for a secure, albeit detachable, fit. In the event that it is desired to remove the suspension system (or a portion thereof), a retainer 34 may be removed by merely pushing it down and overcoming the grasping forces engendered by the nub 32 and the socket 20.

It should be noted that the flat surfaces 50 are specially sized and shaped to fully seat themselves against the lands 30. In this fashion, when an impact load is impressed against the helmet 10, the wings 46 flex, thereby absorbing a portion of the shock rather than transmitting it directly to the head of the wearer.

Accordingly, the wearer of a safety helmet employing the aforementioned design is afforded triple protection. That is, the shell 10 absorbs the direct impact of a sharp blow and dissipates a portion of it over the entire surface area of the helmet. The interior system of flexible webbing 42 further dissipates the impact force and prevents direct contact between the head and the shell. Moreover, the flexible (and removeable) strap retainers 34 provide a final energy attenuating means by directly absorbing a portion of the kinetic energy engendered by the blow. By allowing the wings 46 to flex in registry with the lands 50, a sharp blow (already reduced in strength) is further attenuated.

While in accordance with the provisions of the statutes, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. In combination with a helmet, the helmet including an impact-resistant shell, a suspension harness made from a plurality of straps, the harness disposed within the shell, and a headband in registry with the harness, a shock absorbing suspension system, the system comprising a plurality of harness receiving sockets integrally formed within the shell, the sockets including an indentation formed within the shell, shell extensions partially protruding into the indentation and spaced away from the shell forming a recess between the shell and the extension, the upper portion of each extension forming a land bridging the recess between the shell and each extension, a number of strap retainers removably disposed within the sockets, the retainers having flexible means in registry with the lands formed within the sockets for absorbing and dissipating blows to the shell, means for temporarily affixing the headband to the strap retainers, and means for engaging the straps with the strap retainers.

2. The combination according to claim 1 wherein the strap retainers include a J-shaped structure, the longer section of the structure having an aperture and a plurality of means for removably attaching the headband to the retainers, and the shorter section of the structure having an aperture and a pair of slots forming a pair of shock absorbing flexible wings.

3. The combination according to claim 2 wherein the straps engage the retainer through the apertures.

4. The combination according to claim 2 wherein a nub is formed within the shell, the nub substantially disposed between the extensions, and the strip retainer including a nub receiving recess.

5. The combination according to claim 4 wherein the retainers are disposed within the sockets in such a manner that the nub projects into the nub receiving recess to securely engage the retainer to the socket.

6. The combination according to claim 2 wherein at least a portion of the flexible wings are in a registery with the lands.

7. The combination according to claim 6 wherein a flat surface is disposed on each wing, the flat surface in registry with the lands.

* * * * *